US008225890B2

(12) United States Patent
Scott

(10) Patent No.: US 8,225,890 B2
(45) Date of Patent: Jul. 24, 2012

(54) IMPREGNATED BIT WITH INCREASED BINDER PERCENTAGE

(75) Inventor: Dan E. Scott, Montgomery, TX (US)

(73) Assignee: Baker Hughes Incorporated, Houston, TX (US)

( * ) Notice: Subject to any disclaimer, the term of this patent is extended or adjusted under 35 U.S.C. 154(b) by 280 days.

(21) Appl. No.: 12/427,429

(22) Filed: Apr. 21, 2009

(65) Prior Publication Data

US 2010/0263938 A1 Oct. 21, 2010

(51) Int. Cl.
*E21B 10/36* (2006.01)

(52) U.S. Cl. ..... 175/420.2; 175/425; 175/426; 175/434

(58) Field of Classification Search ..... 175/420.2, 175/425, 426, 434; 428/403, 336
See application file for complete search history.

(56) References Cited

U.S. PATENT DOCUMENTS

| | | | | | |
|---|---|---|---|---|---|
| 3,106,973 | A | | 10/1963 | Christensen | |
| 3,650,714 | A | * | 3/1972 | Farkas | 51/295 |
| 3,841,852 | A | * | 10/1974 | Wilder et al. | 51/295 |
| 4,128,136 | A | | 12/1978 | Generoux | |
| 4,234,048 | A | | 11/1980 | Rowley | |
| 5,011,514 | A | | 4/1991 | Cho et al. | |
| 5,049,164 | A | * | 9/1991 | Horton et al. | 51/295 |
| 5,755,299 | A | * | 5/1998 | Langford et al. | 175/375 |
| 6,095,265 | A | | 8/2000 | Alsup | |
| 6,138,779 | A | | 10/2000 | Boyce | |
| 6,238,280 | B1 | | 5/2001 | Ritt et al. | |
| 6,458,471 | B2 | | 10/2002 | Lovato et al. | |
| 6,510,906 | B1 | | 1/2003 | Richert et al. | |
| 6,742,611 | B1 | | 6/2004 | Illerhaus et al. | |
| 7,303,030 | B2 | * | 12/2007 | Lockwood et al. | 175/374 |
| 2005/0117984 | A1 | | 6/2005 | Eason et al. | |
| 2006/0081402 | A1 | * | 4/2006 | Lockwood et al. | 175/374 |
| 2007/0102198 | A1 | | 5/2007 | Oxford et al. | |
| 2007/0102199 | A1 | | 5/2007 | Smith et al. | |
| 2008/0017421 | A1 | * | 1/2008 | Lockwood | 175/434 |
| 2008/0073127 | A1 | | 3/2008 | Zhan et al. | |
| 2008/0202821 | A1 | | 8/2008 | McClain et al. | |
| 2008/0314646 | A1 | | 12/2008 | Lockwood et al. | |
| 2009/0078469 | A1 | * | 3/2009 | Drivdahl et al. | 175/374 |

OTHER PUBLICATIONS

Frazelle, Andrew, et al., "Real-Time Development of New Tehchnology Saves Operator $5.1 Million in Drilling Deep Exploration Well, Colombia", SPE/IADC 91862, Feb. 2005—1-12.

Hendricks, Peter, et al., "New Application Impregnated Diamond Bit on High Speed Motor" A Team Approach to Performance Improvement, SPE 68090, Mar. 2001, 1-13.

(Continued)

*Primary Examiner* — Cathleen Hutchins
(74) *Attorney, Agent, or Firm* — Steve Rosenblatt

(57) ABSTRACT

Control of the carbide volume in the matrix in an impregnated bit is accomplished by coating the hard particles in the matrix to space them further apart to increase the soft binder percentage in a controllable manner. The softer binder due to lower volume content of hard particles allows more rapid matrix wear in the softer formations to allow more diamond grit to cut better before getting flat spots and to be replaced faster with additional diamond grit further into the matrix as the higher content of the softer binder and the softer coating on the hard particles in the matrix promotes more effective cutting with more frequent emergence of diamond grit on the bit face as cutting progresses.

20 Claims, 2 Drawing Sheets

OTHER PUBLICATIONS

Brackin, Van, et al., "Expanding the Range of Impregnated Technology": New Performance Benchmark Set in Middle East (Et Al), IADC/SPE 74524, Feb. 2002, 1-14.

West, Cory W., et al., "Application if New Impregnated Diamond Bit Technology Saves perator $2 Milling Drilling Southern Oklahoma Well", IADC/SPE 87096, Mar. 2004, 1-20.

Stapel, G., et al., "Innovative Steerable System, Combined With Block Set Impregnated Diamond Bit Design, Dramitically, Improves Economics of Dutch Hohrizontal Well", IADC/SPE 35112, Mar. 1996, 571-581.

* cited by examiner

IMPREGNATED BIT WITH INCREASED BINDER PERCENTAGE

FIELD OF THE INVENTION

The field of the invention is diamond impregnated bits and more particularly the manner in which the matrix durability is altered to improve rate of penetration and bit life.

BACKGROUND OF THE INVENTION

So-called "impregnated" drag bits have been used conventionally for drilling rock formations that are hard, abrasive, or both. More particularly, conventional earth boring drag bits with diamond-impregnated cutting structures, commonly termed "segments," or, alternatively, discrete diamond-impregnated cutting structures have been employed to bore through very hard and abrasive formations, such as basalt, dolomite, and hard sandstone. These conventional impregnated drag bits typically employ a cutting face comprising a diamond impregnated material, which refers to an abrasive particle or material, such as natural or synthetic diamond grit, uniformly dispersed within a matrix of surrounding material. As a conventional impregnated drag bit drills, the matrix wears to expose the abrasive particles, the abrasive particles also wear, and worn abrasive particles may be lost and new abrasive particles, which were previously surrounded by matrix material, may be exposed.

In fact, many conventional diamond impregnated segments may be designed to release, or "shed," such diamonds or grit in a controlled manner during use of the drag bit. As a layer of diamonds or grit is shed from the face, underlying diamonds are exposed as abrasive cuttings and the diamonds that have been shed from the drag bit wear away the exposed continuous phase of the segment in which the interior diamonds are substantially uniformly dispersed until the entire diamond-impregnated portion of the bit has been consumed. Thus, drag bits with diamond-impregnated segments may maintain a substantially constant boring rate or rate of penetration, assuming a homogeneous formation, as long as diamonds remain exposed on such segments.

Regarding conventional abrasive-impregnated cutting structures, the abrasive material with which the continuous matrix material is impregnated preferably comprises a hard, abrasive and abrasion-resistant particulate material, and most preferably a super-abrasive material, such as natural diamond, synthetic diamond, or cubic boron nitride.

The impregnated segment may include more than one type of abrasive material, as well as one or more sizes or quality grades of abrasive material particles. In conventional abrasive-impregnated cutting structures, the abrasive is substantially homogeneously distributed (i.e., not segregated) within the continuous matrix material. The continuous matrix material may be chosen for wettability to the abrasive particles, mechanical properties, such as abrasion resistance, or both, and may comprise one or more of copper, a copper-based alloy, nickel, a nickel-based alloy, cobalt, a cobalt-based alloy, iron, an iron-based alloy, silver, or a silver-based alloy.

Two general approaches are conventionally employed to fabricate drag bits having abrasive-impregnated cutting structures.

In a first approach, an abrasive-impregnated cutting structure may be cast integrally with the body of a drag bit, as by low-pressure infiltration. For instance, one conventional abrasive-impregnated cutting structure configuration includes placing abrasive material into a mold (usually mixed with a molten wax) as by hand-packing, as known in the art.

Subsequently, the mold may be filled with other powders and a steel core and the entire assembly heated sufficiently to allow the infiltrant, such as a molten alloy of copper or tin to infiltrate the powders and abrasive material. The result, upon the infiltrant cooling and solidifying, is a bit body, which has abrasive-impregnated cutting structures bonded thereto by the continuous matrix of the infiltrant.

In a second approach, the abrasive-impregnated cutting structures may be preformed or fabricated separately, as in hot isostatic pressure infiltration, and then brazed or welded to the body of a drag bit. Thus, conventional abrasive-impregnated cutting structures may be formed as so-called "segments" by hot-pressing, infiltration, or the like, which may be brazed or otherwise held into a bit body after the bit body is fabricated. Such a configuration allows for the bit body to include infiltrants with higher melting temperatures and to avoid damage to the abrasive material within the abrasive-impregnated cutting structures that would occur if subjected to the higher temperatures.

In a third process preformed segments are placed in the mold and then matrix added and infiltrated as in example one above.

In a fourth process encapsulated grit is dispersed within the matrix, etc. and then cast as example one mentioned above.

As known in the art, diamond impregnated segments of drag bits may be typically secured to the boring end, which is typically termed the "face," of the bit body of the drag bit, oriented in a generally radial fashion. Impregnated segments may also be disposed concentrically or spirally over the face of the drag bit. As the drag bit gradually grinds through a very hard and abrasive formation, the outermost layer of the impregnated segments containing abrasive particles wear and may fracture, as described above. For instance, U.S. Pat. No. 4,234,048 (the "'048 patent"), which issued to David S. Rowley on Nov. 18, 1980, discloses an exemplary drag bit that bears diamond-impregnated segments on the crown thereof. Typically, the impregnated segments of such drag bits are C-shaped or hemispherically shaped, somewhat flat, and arranged somewhat radially around the crown of the drag bit. Each impregnated segment typically extends from the inner cone of the drag bit, radially outwardly therefrom and up the bit face to the gage. The impregnated segments may be attached directly to the drag bit during infiltration or partially disposed within a slot or channel formed into the crown and secured to the drag bit by brazing.

Alternatively, conventional discrete, post-like cutting structures are disclosed in U.S. Pat. Nos. 6,458,471 and 6,510,906, both of which are assigned to the assignee of the present invention and each of the disclosures of which are incorporated, in their entirety, by reference herein.

U.S. Pat. No. 3,106,973 issued to Christensen on Oct. 15, 1963, discloses a drag bit provided with circumferentially and radially grooves having cutter blades secured therein. The cutter blades have diamond impregnated sections formed of a matrix of preselected materials.

U.S. Pat. No. 4,128,136 issued to Generoux on Dec. 5, 1978, discloses a diamond coring bit having an annular crown and inner and outer concentric side surfaces. The inner concentric side surface of the crown defines a hollow core in the annular crown of the bit for accommodating a core sample of a subterranean formation. The annular crown is formed from a plurality of radially oriented composite segments impregnated with diamonds radially and circumferentially spaced apart from each other by less abrasive spacer materials.

U.S. Pat. No. 6,095,265 to Alsup discloses an adaptive matrix including two or more different abrasive compositions in alternating ribs or in staggered alternating zones of each rib to establish different diamond exposure in specified areas of the bit face. Alsup further discloses that the abrasive compositions for adaptive matrix bits contain diamond and/or other super-hard materials within a supporting material. The supporting material may include a particulate phase of tungsten carbide and/or other hard compounds, and a metallic binder phase of copper or other primarily non-ferrous alloys. Alsup discloses that the properties of the resulting metal-matrix composite material depend on both the percentage of each component and the processing that combines the components. Further, Alsup discloses that the size and type of the diamonds, carbide particles, binder alloy or other components can also be used to effect changes in the overall abrasive or erosive wear properties of the abrasive composition. Additionally, such adjacent "hard" and "soft" ribs may purportedly facilitate fluid cleaning in and around the ribs.

U.S. Pat. No. 6,458,471 to Lovato et al., assigned to the assignee of the present invention and the disclosure of which is incorporated herein its entirety by reference thereto, discloses cutting elements including an abrasive-impregnated cutting structure having an associated support member, wherein the support member is securable to an earth boring rotary-ype drag bit body and provides mechanical support to the cutting structure.

U.S. Pat. No. 6,742,611 to Illerhaus et al., assigned to the assignee of the present invention and the disclosure of which is incorporated herein its entirety by reference thereto, discloses a first cutting element segment formed of a continuous-phase solid matrix material impregnated with at least one particulate super abrasive material, the first cutting element segment juxtapositioned with at least one second cutting element segment formed of a continuous-phase solid matrix material to form a laminated cutting element. Preferably, the at least one second cutting element segment is essentially devoid of impregnated super abrasive or abrasive particles. Alternatively, the at least one second cutting element segment can be impregnated with a preselected, secondary, particulate super abrasive material that results in the at least one second segment being less abrasive and less wear resistant than the at least one first abrasive segment.

While the above-discussed conventional abrasive-impregnated cutting structures and drag bits may perform as intended, it may be appreciated that improved abrasive-impregnated cutting structures and drag bits would be desirable. Further, it would be desirable to improve abrasive-impregnated cutting structures that exhibit selectable wear characteristics.

In a conventional diamond impregnated bit, the soft binder alloy makes up about 30-40% of the "face" powder material where the cutting action takes place. The remainder is a mixture of diamond grit, and the matrix hard metal which is about 60-70% combined. The typical binder is a copper base alloy with a composition of approximately 77% copper, 10% nickel, and 5% Manganese and 5% tin. The hard particle matrix material is typically a blend of crushed sintered tungsten carbide (WC—Co), eutectic cast carbide (WC—W2C), macro crystalline tungsten carbide and a small amount of nickel powder. The ratios of these vary depending upon the application requirements and are used to control the wear rate of the matrix to match that required for the abrasive characteristics of the formation.

Two things control the wear rate of the matrix bit at the rock-drill bit interface. The ratio of the three hard particle constituents to each other mentioned above, and the amount of binder, or soft phase as a percentage of the total bit. One of the objects of the present invention is to control the ratio of hard particle to binder, which, to a large extent controls the wear rate of the composite. Varying the hard particle grain size has some but a much lower influence than the percentage of binder in the bit.

The faster the wear rate, the faster new diamond grit is exposed to the formation, and the higher the effective projection or protrusion of the diamond, and the quicker more new sharp diamonds are exposed which aids in rate of penetration and tool life. The slower the wear rate, the less new diamond is exposed to the formation, and the lower the projection or protrusion of the diamond grit, resulting in a lower rate of penetration, shorter bit life as the grit glazes over and develops a large wear flat, and loses its ability to cut effectively. This is very much application dependent, depending upon the abrasiveness and strength of the formation and the operating parameters.

In less abrasive and softer formations it is desirable to have a faster wear rate for the matrix material holding the diamond grit in order to promote increased effective protrusion and rate of penetration. One way to do this is by increasing the effective binder content of the bit body, or raising the ratio of binder to hard matrix materials. It is difficult to lower the hard particle concentration, and raise the binder portion in a controlled manor due to the packing of the carbide particles during handling in the mold in manufacturing, and by segregation of the nickel powders when they are added.

FIG. 1 is a photomicrograph of a known mixture of matrix hard materials identified and labeled as A, B, and C with the unlabeled gray areas being the binder. It makes it easier to appreciate the difficulty in getting the desired result by simply adding more binder as the hard material distribution in the bit mold is difficult to manage in view of the random way the particles orient themselves.

By using metal coated carbide particles of the present invention it is possible to raise the effective soft metal, or binder content, in a controlled and measured amount and reduce the hard particle content thus increasing the ratio of binder to hard matrix material, resulting in a predictable and measurable rate of wear that is suitable for the intended application. Binder ratios of in excess of 40% and as high as about 70% are anticipated to be required, to get the appropriate wear rate. The preferred range is 40-50% binder ratio. Coatings can preferably be applied in one or more layers and can vary in total thickness from 5 microns to over 30 microns with a range between 5 and 20 microns preferred.

Various means of applying the metal coating are known to those skilled in the art. Fluidized bed, CVD, PVD, plating, etc are all possible means of applying a controlled thickness of metal to the hard carbide particles. The metal may be tungsten, nickel, copper, cobalt, iron, and many others which area easy to vapor deposit, and which are compatible with the binder alloys. The metal coating is soft and functions equivalently to simply adding additional binder with the added advantage of adhering to the hard particles so that the effect is a more uniform softening of the matrix to allow the more rapid exposure of new diamond cutters for an increase in bit life and rate of penetration.

Some applications have applied hard facing to cutting structures such as in roller cone bits as illustrated in U.S. Pat. No. 7,303,030; US Publication 2008/0073127 and US Publication 2008/0314646. U.S. Pat. No. 5,049,164 is generally related to coating cutting structures.

SUMMARY OF THE INVENTION

Control of the carbide volume in the matrix in an impregnated bit is accomplished by coating the hard particles in the matrix to space them further apart to increase the soft binder percentage in a controllable manner. The softer binder due to lower volume content of hard particles allows more rapid matrix wear in the softer formations to allow more diamond grit to cut better before getting flat spots and to be replaced faster with additional diamond grit further into the matrix as the higher content of the softer binder and the softer coating on the hard particles in the matrix promotes more effective cutting with more frequent emergence of diamond grit on the bit face as cutting progresses.

DETAILED DESCRIPTION OF THE PREFERRED EMBODIMENT

Figure 1:
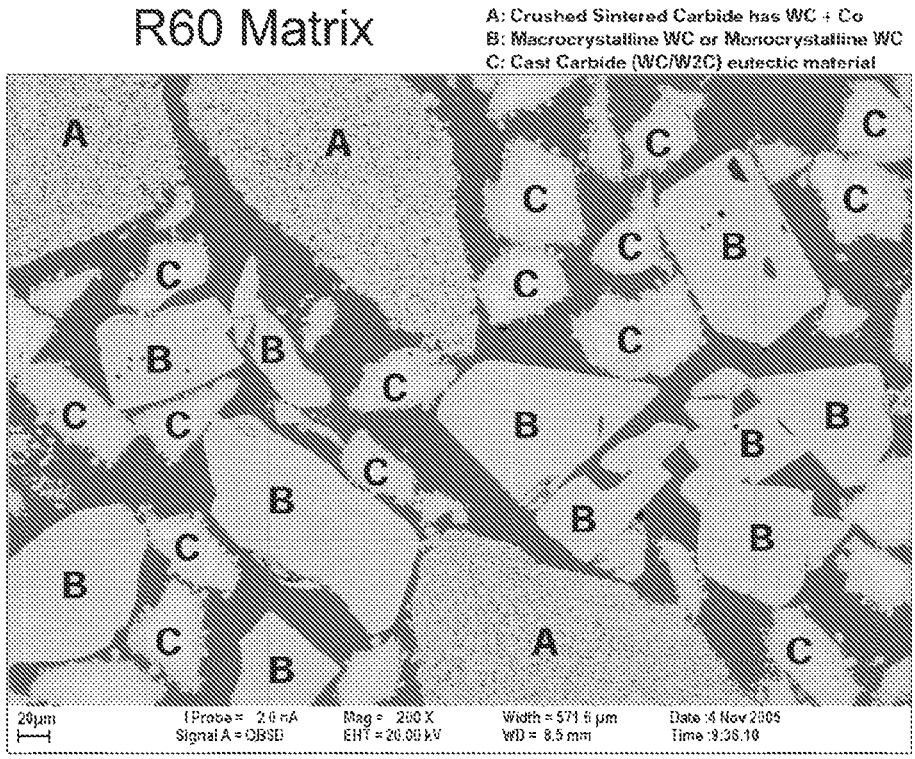
(PRIOR ART) FIG. 1
FIG. 1 is a matrix photomicrograph showing an existing formulation with hard particles and a binder.
Figure 2:
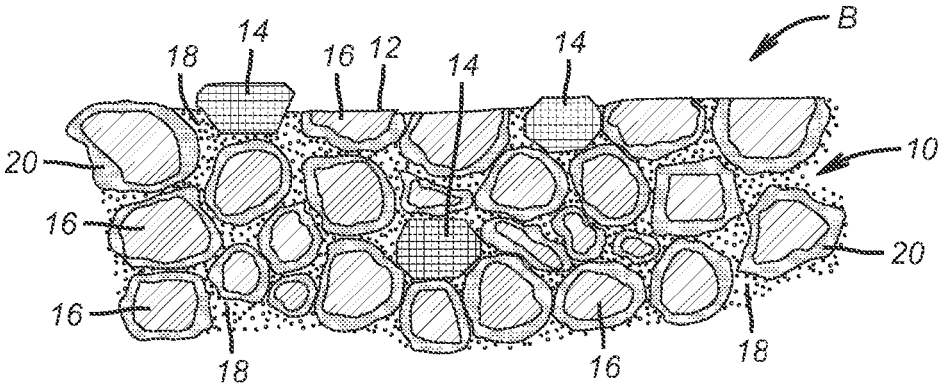
FIG. 2 illustrates a matrix using the present invention to apply a coating to the hard particles that spaces them further apart and reduces the hard particle volume percentage.
Figure 3:
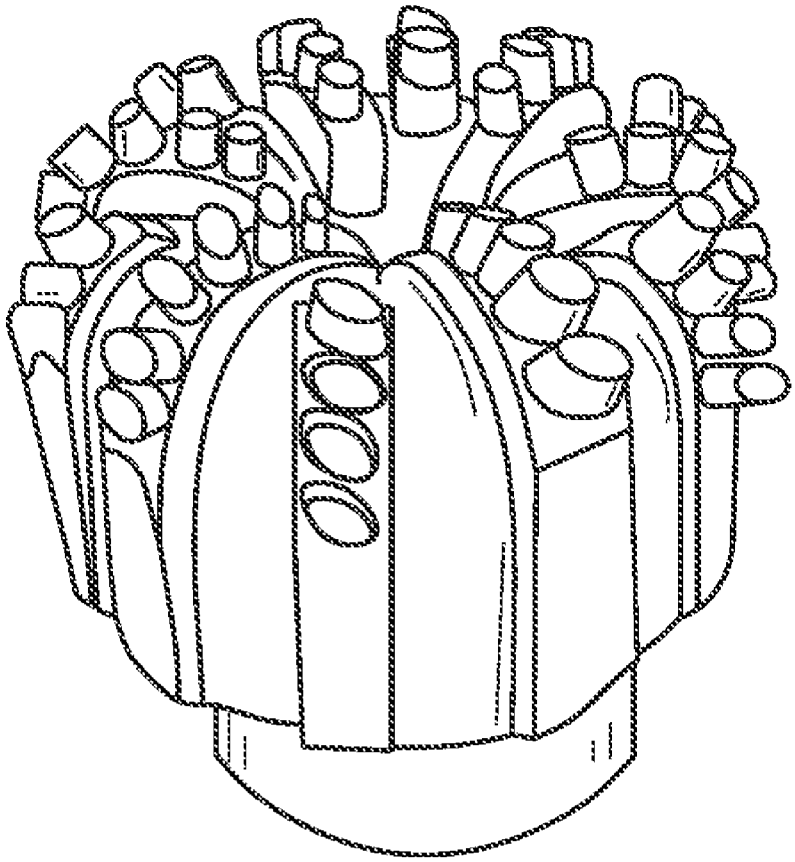
FIG. 3 is a perspective view of a drag bit.

FIG. 2 simulates a photomicrograph to illustrate the present invention by showing a highly magnified portion of the body 10 of an impregnated bit matrix B where the top of the FIG. 2 represents the bit face 12. Diamond grit 14 extends in varying degrees through the face 12 before cutting begins and throughout the matrix B. The principle of operation is that the diamond grit 14 on the face 12 starts the cutting of the formation and wears as a result along with the surrounding matrix that holds the diamond grit 14 in position. The surrounding matrix B wears as well and at some point the diamond grit 14 is knocked out of the matrix B at the approximate time that additional grit 14 becomes exposed to maintain the optimal rate of penetration.

In certain soft formations the currently available matrix B formulations are too abrasive wear resistant leading to overly long exposure of a given number of diamond grit particles 14 until such grit gets flat spots and loses its ability to effectively penetrate the formation at the desired rates. The objective of the present invention is to control the wear rate of the matrix B by reducing the hard material 16 volume ratio in the matrix B. As previously stated it is difficult to achieve the needed uniformity in the matrix B by simply reducing the number of hard particles 16 that go into the making of the matrix B along with a binder material 18. One reason for this is that there is material migration during the manufacturing process and the random nature in which the hard particles 16 order themselves. As a result the approach toward controlling the wear rate of the matrix B is to increase the spacing among the hard particles 16 with a coating 20.

The coating can be in one or more layers and is preferably at least 5 microns to about 20 microns thick and can range with the application to over 30 microns around the hard particles 16. Coating 20 can comprise layers of nickel over copper or the reverse can be used and may actually wind up more cost effective than a single layer. Other metals which can be plated or vapor deposited would work as well for the coating 20, depending upon their ability to react with or be dissolved, in a limited or controlled manner. The outer layer in a multi layer system controls the dissolution of the coating 20 into the main binder during the infiltration process. Molten copper dissolves many metals to form a solid solution with copper. Outermost coating layers that do not dissolve into the binder 18 are also envisioned. Iron, tungsten or cobalt could also be used. In another variation, one of the arrays of hard metal particles used such as the WC particle can be tungsten coated and then coated with nickel followed by an outermost layer of copper, While this technique can cost more the technology is currently available to accomplish it reliably. Vapor coated silicon carbide as an innermost layer of the coating over the carbide grit 16 is another option, followed by a copper or nickel layer or both in either order.

The coating 20 is softer than the particles 16 to which it is applied and can be considered additional binder 18 from a perspective of wear resistance of the matrix B. The goal is to make the matrix less resistant to wear by increasing the volume percentage of binder 18 in the matrix B with the coating 20 volume considered a part of the binder volume percentage. Clearly, the thicker the coating 20 the less is the volume taken up by the hard materials 16 and the lower the resistance to wear exhibited by the matrix B. In turn, in softer formations, the wear of the matrix is enhanced to expose diamond grit 14 more optimally until while it is near its peak of cutting performance it gets dislodged to expose additional diamond grit 16 to continue the established rate of penetration. Total binder 18 volume and coating 20 volume can range from about 40% to about 70% of the matrix B with the preferred range being 40-50%. Typically the binder 18 is approximately 10% nickel, 5% manganese, 5% tin, and balance copper. The hard materials 16 can be combinations of crushed sintered carbide and cast carbide; or crushed sintered carbide, microcrystalline WC, cast carbide and nickel in differing concentrations. Trace amounts of an organic binder, which is used like a wax to help in packing the mold and which is 'burned off' or evaporated away before infiltrating, can also be used.

Those skilled in the art will appreciate that the present invention employs coatings on the hard metal particles in the matrix to control the binder volume percentage as a way of optimizing the effectiveness of the diamond grit particles in an impregnated drill bit. The overriding concept is that the performance of the bit can be enhanced by making the matrix less wear resistant and subsidiary to that concept is the execution of how to accomplish reducing the abrasion resistance of the matrix in a uniform fashion by using adhered coatings to the hard particles to space them apart and while doing so raising the volume percentage of the relatively soft and low abrasion resistance of the binder material and the relatively low abrasion resistance of the coating. The coating can be applied in a single layer of a single material or can involve multiple discrete layers of different materials with the coating thickness dependent on the desired volume percentage target for binder and like material as far as abrasion resistance in the matrix. Volume percentages in the range of about 40-60% binder are envisioned for use in relatively soft formations including but not limited to interbedded sand and shale sequences, sandy siltstone, and sandy mudstone, and similar formations which are moderately abrasive, but can be difficult to drill unless the matrix bit wears at an acceptable rate.

The above description is illustrative of the preferred embodiment and many modifications may be made by those skilled in the art without departing from the invention whose scope is to be determined from the literal and equivalent scope of the claims below.

I claim:

1. An abrasive-impregnated cutting structure for use on a rotary drag bit for drilling a subterranean formation, comprising:

a plurality of diamond cutting particles and a matrix of hard carbide random grain shaped particles held with a binder;

said matrix selectively retaining said cutting particles that perform the bulk of the cutting by the bit until physical separation of said cutting particles from said matrix;

the percentage of hard particles in said matrix is controlled by a metallic coating on at least some of said hard particles to weaken the ability of said matrix to retain said cutting particles and in turn to optimize the rate additional cutting particles extend from said matrix to continue cutting by the bit.

2. The cutting structure of claim 1, wherein:
said coating spaces apart said hard particles.

3. The cutting structure of claim 1, wherein:
said coating and said binder comprise at least 40% by volume of said matrix.

4. The cutting structure of claim 3, wherein:
said coating and said binder comprise between about 40% and 50% by volume of said matrix.

5. The cutting structure of claim 3, wherein:
said coating is at least 5 microns thick.

6. The cutting structure of claim 5, wherein:
said coating has at least one layer.

7. The cutting structure of claim 6, wherein:
said coating comprises at least one of tungsten, iron, cobalt, copper and nickel.

8. The cutting structure of claim 7, wherein:
copper comprises the outermost layer of said coating.

9. The cutting structure of claim 8, wherein:
said coating and said binder comprise between about 40% and 50% by volume of said matrix.

10. The cutting structure of claim 9, wherein:
said coating at least in part dissolves into said binder.

11. The cutting structure of claim 7, wherein:
said coating does not dissolve into said binder.

12. The cutting structure of claim 7, wherein:
said coating comprises layers of copper and nickel.

13. The cutting structure of claim 1, wherein:
said coating is at least 5 microns thick.

14. The cutting structure of claim 1, wherein:
said coating has at least one layer.

15. The cutting structure of claim 1, wherein:
said coating comprises at least one of tungsten, iron, cobalt, copper and nickel.

16. The cutting structure of claim 15, wherein:
copper comprises the outermost layer of said coating.

17. The cutting structure of claim 15, wherein:
said coating comprises layers of copper and nickel.

18. The cutting structure of claim 15, wherein:
said coating comprises an innermost layer of tungsten covered by at least one layer of at least one of copper and nickel.

19. The cutting structure of claim 18, wherein:
said tungsten layer is covered by nickel which is in turn covered by copper.

20. The cutting structure of claim 1, wherein:
said coating at least in part dissolves into said binder.

* * * * *